US007152506B2

(12) United States Patent
Wang

(10) Patent No.: US 7,152,506 B2
(45) Date of Patent: Dec. 26, 2006

(54) PUSH OPENER

(75) Inventor: Soo Chang Wang, Seoul (KR)

(73) Assignee: Korea Alphaline Co., Ltd., Seoul (KR)

( * ) Notice: Subject to any disclaimer, the term of this patent is extended or adjusted under 35 U.S.C. 154(b) by 120 days.

(21) Appl. No.: 10/511,689

(22) PCT Filed: Apr. 16, 2003

(86) PCT No.: PCT/KR03/00765

§ 371 (c)(1),
(2), (4) Date: Oct. 14, 2004

(87) PCT Pub. No.: WO03/089362

PCT Pub. Date: Oct. 30, 2003

(65) Prior Publication Data

US 2005/0252344 A1 Nov. 17, 2005

(30) Foreign Application Priority Data

Apr. 16, 2002 (KR) ..... 20-2002-0011510

(51) Int. Cl.
*B67B 7/62* (2006.01)

(52) U.S. Cl. ..... 81/3.55; 81/3.29; 81/3.37; 81/3.56

(58) Field of Classification Search ..... 81/3.55, 81/3.56, 3.07, 3.08, 3.37, 3.29, 3.49, 3.5
See application file for complete search history.

(56) References Cited

U.S. PATENT DOCUMENTS

| | | | | |
|---|---|---|---|---|
| 2,070,212 | A * | 2/1937 | Minden | 81/3.55 |
| 4,414,866 | A * | 11/1983 | Kichijyo | 81/3.56 |
| 4,433,597 | A * | 2/1984 | Rowland | 81/3.09 |
| 5,033,141 | A * | 7/1991 | Kang | 81/3.55 |
| 6,957,599 | B1 * | 10/2005 | Corredor et al. | 81/3.09 |

* cited by examiner

*Primary Examiner*—Hadi Shakeri
(74) *Attorney, Agent, or Firm*—Roth & Goldman, P.A.

(57) ABSTRACT

Disclosed is a push opener suitable for removing a cap (12) fitted to an opening of a bottle (10). The push opener includes an intermediate lid (31) having an elongate arm, a first operation arm (32) formed with an engagement projection to be engaged with a lower end of the bottle cap, a second operation arm (33) for supporting an upper end of the bottle cap, an inclined arm (34) hinged to the first operation arm (32) and positioned directly below the elongate arm of the intermediate lid (31), to be pivoted and raise the first operation arm (32) when an opener body (20) is pushed downward, a spring (36) for returning the pivoted inclined arm (34) to its original position, an inner housing (20*b*) formed of transparent material, an outer housing formed of transparent material and positioned radially outward of the inner housing, and a first advertising section (25) provided the inner housing (20*b*) or the outer housing (20*d*).

2 Claims, 3 Drawing Sheets

PUSH OPENER

TECHNICAL FIELD

The present invention relates, in general, to a push opener for removing a cap from a bottle and, more particularly, to a push opener which is provided with an advertising section for allowing a variety of ads to be putted therein to thereby accomplish certain degrees of advertisement and sales promotion effects.

BACKGROUND ART

Generally, a cap is fitted to an opening of a bottle for liquids such as beverages and liquors. The cap can be removed by twisting and rotating the cap using the hand or by employing a separate opener made of steel.

Openers are divided into a lever type opener for removing a cap by leverage and a push type opener (hereinafter referred to as a "push opener"). In the push opener, an upper end portion of a bottle, including a cap, is inserted into an opened lower end of the push opener, and then by pushing downward a body of the push opener, the cap is removed from the bottle.

While the conventional lever type opener having an advertisement has been disclosed in the art, a push opener provided with an advertising section has not been disclosed in the art. Therefore, in the art, there is increasing demand for a push opener having an advertising section capable of accomplishing certain degrees of advertisement and sales promotion effects.

DISCLOSURE OF THE INVENTION

Accordingly, the present invention has been made keeping in mind the above problems occurring in the prior art, and an object of the present invention is to provide a push opener which is provided with an advertising section.

Another object of the present invention is to provide a push opener in which a filler element is placed in a space defined between inner and outer housings constituting an opener body, to stimulate one's curiosity and improve an aesthetic appearance of the push opener.

In order to achieve the above objects, according to the present invention, there is provided a push opener suitable for removing a cap fitted to an opening of a bottle, including an intermediate lid which is positioned below an upper lid and has a downwardly extending elongate arm, a first operation arm which is formed with an engagement projection to be engaged with a lower end of the bottle cap, a second operation arm which is positioned separately from the first operation arm to support an upper end of the bottle cap, an inclined arm having one end which is hinged to the first operation arm and the other end which is positioned directly below the elongate arm of the intermediate lid, to be pivoted and thereby raise the first operation arm when an opener body is pushed downward, and a spring for returning the pivoted inclined arm to its original position, the push opener comprising: an inner housing formed of transparent material; an outer housing formed of transparent material and positioned radially outward of the inner housing such that a space is defined between the outer and inner housings; and a first advertising section provided to the inner housing or the outer housing.

According to another aspect of the present invention, the upper lid is detachably coupled to an upper end of the opener body, and a second advertising section is provided to the upper cap.

According to still another aspect of the present invention, a filler element is placed in the space defined between the outer and inner housings.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
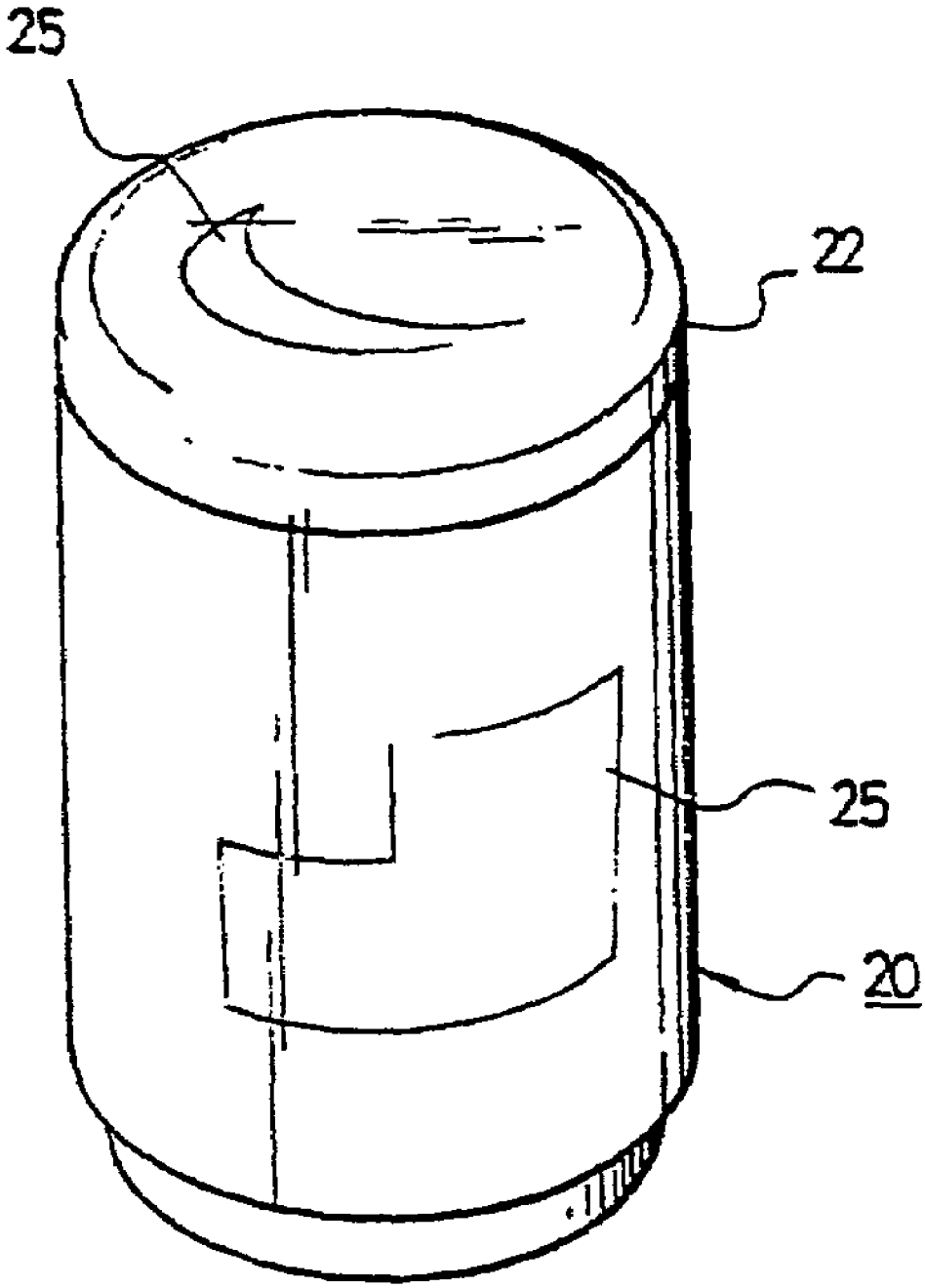
FIG. 1 is a perspective view illustrating an outer appearance of a push opener in accordance with a first embodiment of the present invention.

Reference should now be made to the drawings, in which the same reference numerals are used throughout the different drawings to designate the same or similar components.

Figure 2:
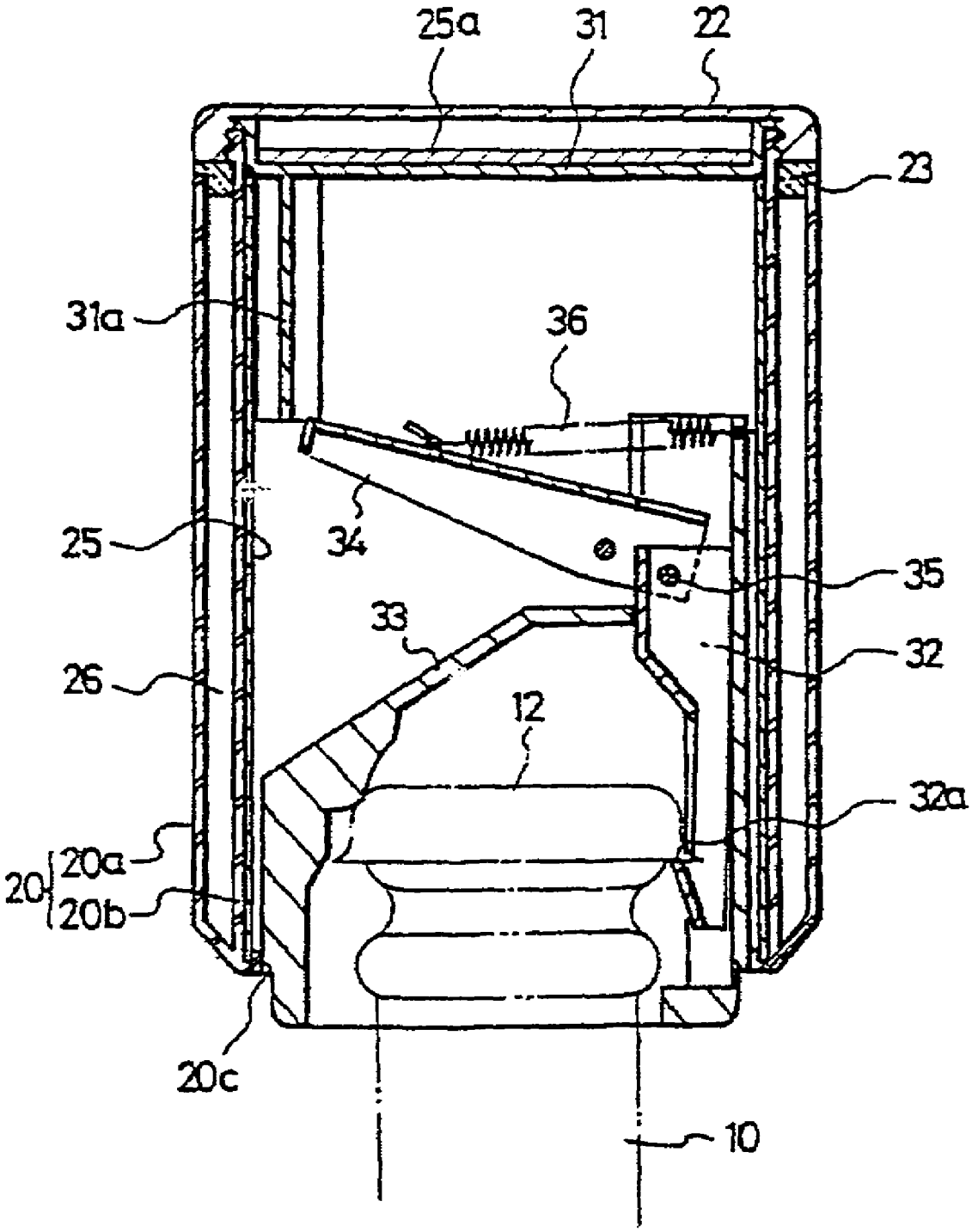
FIG. 2 is a schematic longitudinal sectional view of FIG. 1.

FIG. 1 is a perspective view illustrating an outer appearance of a push opener in accordance with a first embodiment of the present invention; and FIG. 2 is a schematic longitudinal sectional view of FIG. 1. As shown in FIGS. 1 and 2, a push opener in accordance with an embodiment of the present invention is used to remove a cap 12 fitted to an opening of a bottle 10. The push opener comprises an opener body 20 having a cylindrical configuration and a cap removing section (not shown), which is installed in the opener body 20 to remove the cap 12 from the bottle 10.

The opener body 20 is opened at a lower end thereof in a manner such that an upper end portion of the bottle 10, including the cap 12, can be inserted into the opened lower end of the opener body 20. An upper lid 22 is provided to an opened upper end of the opener body 20 in a manner such that the upper lid 22 can open and close the upper end of the opener body 20 by being threadedly rotated. The upper lid 22 may be formed of transparent material as in the case of outer and inner housings 20*a* and 20*b* described later in detail, and a first advertising section 25*a* may be provided to a lower surface of the upper lid 22.

The opener body 20 includes a cylindrical inner housing 20*b*, and an outer housing 20*a* which is positioned radially outward of the inner housing 20*b* such that a space is defined between the outer and inner housings 20*a* and 20*b*. While it was explained that the opener body 20 according to this preferred embodiment of the present invention has the cylindrical configuration, it can be envisaged that the opener body 20 may have a quadrangular or a triangular configuration in consideration of a design of the entire push opener.

The outer and inner housings 20*a* and 20*b* are formed of transparent material. Therefore, a second advertising section 25 (comprising a printed sheet or a printed pattern), as will be described later in detail, can be clearly viewed from the outside.

The advertising section 25 is provided on an inner surface of the inner housing 20*b*. That is to say, since the opener body 20 has the cylindrical configuration, the advertising section 25 is rolled into a cylindrical configuration to be installed on the inner surface of the inner housing 20*b*. When the advertising section 25 is installed on the inner surface of the inner housing 20*b*, a lower end of the advertising section 25 is inserted into an inward flange portion 20*c* which is formed at a lower end of the inner housing 20*b*, whereby the advertising section 25 is prevented from being unintentionally released. In this regard, it can also be contemplated that, without forming the inward flange portion 20*c*, the advertising section 25 can be directly bonded to the inner surface of the inner housing 20*b*. The advertising section 25 may comprise a printed pattern or a printed sheet. A variety of advertising sections 25 can be employed in a manner such that they can be easily replaced one with another.

Due to the fact that the outer and inner housings 20*a* and 20*b* are formed of transparent material, the advertising section 25 provided on the inner surface of the inner housing 20*b* can be viewed from the outside. Of course, it can be noted that the advertising section 25 may be provided in the space defined between the outer and inner housings 20*a* and 20*b*, differently from the above-described embodiment.

In the preferred embodiment of the present invention, a filler element 26 is placed in the space defined between the outer and inner housings 20*a* and 20*b*. The filler element 26 may comprise, for example, liquid such as water, or solid material such as sand or beads of a fine diameter. Due to the presence of the filler element 26, the push opener can stimulate one's curiosity, and an aesthetic appearance of the entire push opener can be improved. At this time, an airtight cap 23 is fitted into an opened upper end of the space defined between the outer and inner housing 20*a* and 20*b*, to prevent the filler element 26 from leaking to the outside.

The cap removing section installed in the opener body 20 to remove the cap 12 from the bottle 10 comprises an intermediate lid 31, a first operation arm 32, a second operation arm 33, an inclined arm 34, and a spring 36. The intermediate lid 31 is positioned below the upper lid 22 and has a downwardly extending elongate arm 31*a*. The first operation arm 32 is formed with an engagement projection 32*a* to be engaged with a lower end of the bottle cap 12. The second operation arm 33 is positioned separately from the first operation arm 32 to support an upper end of the bottle cap 12. The inclined arm 34 has one end which is hinged to the first operation arm 32 and the other end which is positioned directly below the elongate arm 31*a* of the intermediate lid 31, to be pivoted and thereby raise the first operation arm 32 when the opener body 20 is pushed downward. The spring 36 functions to return the pivoted inclined arm 34 to its original position.

When it is necessary to open the cap 12, the upper end portion of the bottle 10, including the cap 12, is inserted into the opened lower end of the opener body 20. By this, the lower end of the bottle cap 12 is engaged with the engaging projection 32*a* of the first operation arm 32.

In this state, the opener body 20 is pushed downward. Then, as the inclined arm 34 is pivoted about a hinge 35, the first operation arm 35 is raised. At this time, since one side of the upper end of the bottle cap 12 is supported by the second operation arm 33 and only the first operation arm 32 is raised while being engaged with the lower end of the bottle cap 12, the cap 12 is opened.

As a consequence, in the present invention, because the advertising section 25 is provided to the push opener for easily opening the bottle cap 12 through simple downwardly pushing operation, certain degrees of advertisement and sales promotion effects can be accomplished.

Also, due to the fact that the filler element 26 is placed in the space defined between the outer and inner housings 20*a* and 20*b*, it is possible to stimulate one's curiosity and improve an aesthetic appearance of the push opener.

It was explained in the above embodiment that the filler element 26 might comprise solid material. In this case, since the advertising section 25 cannot be viewed from the outside, an amount of the solid material must be appropriately adjusted to allow the advertising section 25 to be properly viewed from the outside.

Figure 3:
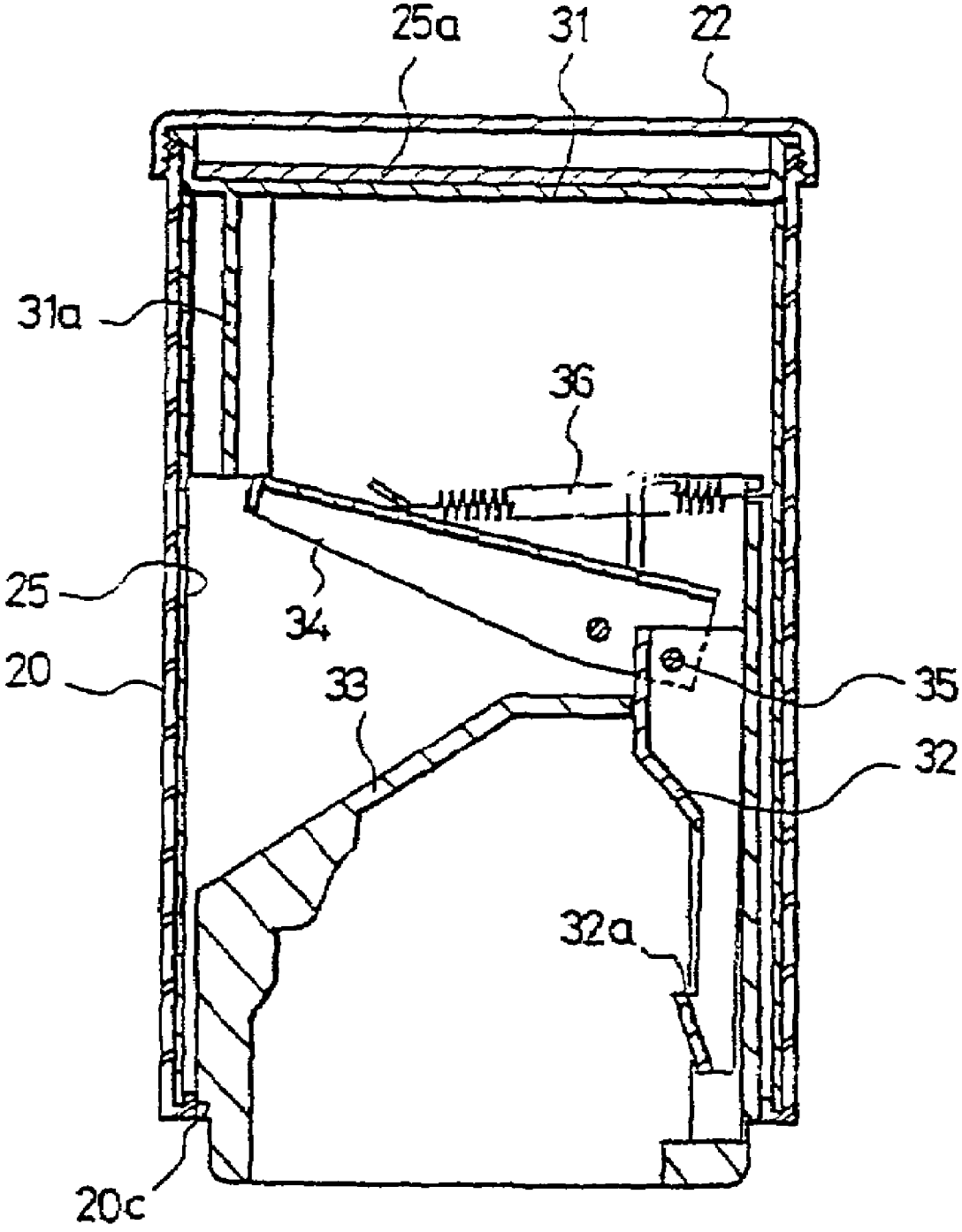
FIG. 3 is a sectional view illustrating a push opener in accordance with a second embodiment of the present invention.

In the above-described first embodiment, it was explained that the opener body 20 comprises the outer and inner housings 20*a* and 20*b*. In this regard, a person skilled in the art will readily recognize that, as shown in FIG. 3, the opener body 20 may comprise a single cylindrical wall instead of being divided into the outer and inner housings 20*a* and 20*b* and the advertising section can be provided to the single cylindrical wall.

INDUSTRIAL APPLICABILITY

As apparent from the above description, the push opener according to the present invention, constructed as mentioned above, provides advantages in that, since the push opener is provided with an advertising section, certain degrees of advertisement and sales promotion effects can be accomplished. Further, because a filler element is placed in a space defined between inner and outer housings constituting an opener body, it is possible to stimulate one's curiosity and improve an aesthetic appearance of the push opener.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A push opener suitable for removing a cap fitted to an opening of a bottle, including an intermediate lid which is positioned below an upper lid and has a downwardly extending elongate arm, a first operation arm which is formed with an engagement projection to be engaged with a lower end of the bottle cap, a second operation arm which is positioned separately from the first operation arm to support an upper end of the bottle cap, an inclined arm having one end which is hinged to the first operation arm and the other end which is positioned directly below the elongate arm of the intermediate lid, to be pivoted and thereby raise the first operation arm when an opener body is pushed downward, and a spring for returning the pivoted inclined arm to its original position, the push opener comprising:

an inner housing formed of transparent material;

an outer housing formed of transparent material and positioned radially outward of the inner housing such that a space is defined between the outer and inner housings; and a first advertising section provided to the inner housing or a vertical surface of the outer housing and a filler element is placed in the space defined between the outer and inner housings.

2. The push opener as set forth in claim 1, wherein the upper lid is detachably coupled to an upper end of the opener body, and a second advertising section is provided to the upper cap.

* * * * *